US008641279B2

(12) United States Patent
Ichikawa et al.

(10) Patent No.: US 8,641,279 B2
(45) Date of Patent: Feb. 4, 2014

(54) PACKAGING BAG WITH FASTENER

(75) Inventors: Toru Ichikawa, Tokyo (JP); Tsutomu Hara, Tokyo (JP); Kazuhiro Umenaka, Tokyo (JP)

(73) Assignee: Hosokawa Yoko Co., Ltd., Tokyo (JP)

( * ) Notice: Subject to any disclaimer, the term of this patent is extended or adjusted under 35 U.S.C. 154(b) by 1287 days.

(21) Appl. No.: 12/293,563

(22) PCT Filed: Feb. 9, 2007

(86) PCT No.: PCT/JP2007/052371
§ 371 (c)(1),
(2), (4) Date: Sep. 19, 2008

(87) PCT Pub. No.: WO2007/108251
PCT Pub. Date: Sep. 27, 2007

(65) Prior Publication Data

US 2010/0158416 A1 Jun. 24, 2010

(30) Foreign Application Priority Data

Mar. 20, 2006 (JP) ..... 2006-077504

(51) Int. Cl.
*B65D 33/16* (2006.01)

(52) U.S. Cl.
USPC ..... 383/65; 383/63; 383/204

(58) Field of Classification Search
USPC ..... 383/42, 200, 203, 204, 207, 61.2, 63, 383/65
See application file for complete search history.

(56) References Cited

U.S. PATENT DOCUMENTS

| | | | | | |
|---|---|---|---|---|---|
| 2,093,974 | A | * | 9/1937 | Farmer | 383/90 |
| 2,369,716 | A | * | 2/1945 | Coghill | 493/189 |
| 2,620,944 | A | * | 12/1952 | Stahl | 222/107 |
| 2,666,466 | A | * | 1/1954 | Sharat | 383/65 |
| 2,780,261 | A | * | 2/1957 | Svec et al. | 383/65 |
| 3,079,292 | A | * | 2/1963 | Chester et al. | 156/269 |
| 3,208,640 | A | * | 9/1965 | Paulson | 222/94 |
| 3,343,664 | A | * | 9/1967 | Poitras | 206/219 |

(Continued)

FOREIGN PATENT DOCUMENTS

| | | |
|---|---|---|
| JP | 10-218188 | 8/1998 |
| JP | 2000-262307 | 9/2000 |

(Continued)

OTHER PUBLICATIONS

Extended European Search Report dated Nov. 30, 2009, Application No. 07708307.9.

*Primary Examiner* — Jes F Pascua
*Assistant Examiner* — Peter Helvey
(74) *Attorney, Agent, or Firm* — Young & Thompson

(57) ABSTRACT

It is aimed to smoothly perform engagement and disengagement of a fastener of a packaging bag and easily take out an inner content by a desired amount. For these purposes, in a packaging bag 1 with a fastener 20 in which a male fastener element and a female fastener element are attached to inner surfaces of opposing flat surface portions 2*a* and an opening is opened or closed by engaging or disengaging both the fastener elements, pick-up tabs 40 are provided so as to project outward at a portion corresponding to a mounting portion of the fastener 20, or near the portion. The fastener is formed to be asymmetric with respect to the center thereof so that one side largely protruded is attached so as to be directed inward of the packaging bag.

6 Claims, 16 Drawing Sheets

(56) References Cited

U.S. PATENT DOCUMENTS

| | | | | | |
|---|---|---|---|---|---|
| 3,397,835 | A | * | 8/1968 | Henning | 383/208 |
| 3,640,381 | A | * | 2/1972 | Kanada et al. | 229/206 |
| 3,663,239 | A | * | 5/1972 | Rowe et al. | 426/113 |
| 3,815,810 | A | * | 6/1974 | Wellman | 383/204 |
| 4,027,819 | A | * | 6/1977 | Herrera-Gutierrez | 383/204 |
| 4,361,235 | A | * | 11/1982 | Gautier | 206/527 |
| 5,116,140 | A | * | 5/1992 | Hirashima | 383/206 |
| 5,836,697 | A | * | 11/1998 | Chiesa | 383/205 |
| 5,931,582 | A | | 8/1999 | Nichols | |
| 6,007,246 | A | * | 12/1999 | Kinigakis et al. | 383/204 |
| 6,120,184 | A | * | 9/2000 | Laurence et al. | 383/205 |
| 6,773,163 | B2 | * | 8/2004 | Ichikawa et al. | 383/204 |
| 6,857,779 | B2 | * | 2/2005 | Olin | 383/204 |
| 6,986,729 | B2 | * | 1/2006 | Ichikawa et al. | 493/213 |
| 7,011,448 | B2 | * | 3/2006 | Olin | 383/66 |
| D545,689 | S | * | 7/2007 | Peel | D9/707 |
| 7,300,207 | B2 | * | 11/2007 | Linneweil | 383/35 |
| 7,331,716 | B2 | * | 2/2008 | Nakano et al. | 383/203 |
| 7,506,487 | B2 | * | 3/2009 | Eads et al. | 53/412 |
| 2003/0016889 | A1 | * | 1/2003 | Ichikawa et al. | 383/204 |
| 2004/0208398 | A1 | * | 10/2004 | Ichikawa et al. | 383/63 |
| 2004/0208400 | A1 | * | 10/2004 | Linneweil | 383/68 |
| 2006/0159371 | A1 | * | 7/2006 | Song | 383/63 |
| 2008/0044115 | A1 | * | 2/2008 | Ichikawa et al. | 383/204 |

FOREIGN PATENT DOCUMENTS

| | | |
|---|---|---|
| JP | 2001-240076 | 9/2001 |
| JP | 2005-144077 | 6/2005 |
| JP | 2005-3500104 | 12/2005 |

* cited by examiner

PACKAGING BAG WITH FASTENER

FIELD OF THE INVENTION

The present invention relates to a packaging bag provided with a fastener for re-closing a spout opening.

BACKGROUND TECHNOLOGY

The applicant of the subject application has disclosed, in Patent Publication 1, a packaging bag with a fastener, in which a spout unit for pouring out a content is provided as a member independent of a bag body, and the spout unit is connected to an attachment opening formed to the bag body. The packaging bag with a fastener disclosed in this Patent Publication 1 is provided with a fastener to the inner surface of a wall portion forming the spout portion.

According to the development of such fastener packaging bag as disclosed in the Patent Publication 1, it becomes easy to maintain the packaging bag with the pouring opening being opened, which was difficult in a conventional packaging bag. This was a significant matter.

Further, there have hitherto provided many inventions disclosing a structure in which a fastener is applied to a packaging bag, and an once-opened packaging bag is re-sealed, and in such structure, the fastener are easily engaged or disengaged, and a male fastener element and a female fastener element are surely engaged together.

For example, in an invention disclosed in Patent Publication 2, a groove is formed to the front end of a male fastener element. According to this invention, even if a content accommodated in a packaging bag adheres to the inside of the groove of a female fastener element, the adhering content is accommodated inside the groove. Accordingly, the fastener elements are surely engaged, and engagement or disengagement of the fastener elements is smoothly performed.

Patent Publication 1: Japanese Patent Application Laid-open Publication No. 2005-350104

Patent Publication 2: Japanese Patent Application Laid-open Publication No. 2005-144077

DISCLOSURE OF THE INVENTION

Problem to be Solved by the Invention

The applicant of the subject application has pursued usability of such a packaging bag even after the disclosing of the invention of such a packaging bag with a fastener in the Patent Publication 1. As a result, there posed a problem such that in what manner the spout opening sealed by the fastener is more easily opened.

The present invention provides a packaging bag provided with a fastener capable of easily opening a spout port by disengaging the fastener elements.

Moreover, the engagement or disengagement of the fastener elements are more smoothly performed, and the fastener is surely engaged.

Means for Solving the Problem

In order to solve the above problems, the present invention provides a packaging bag with a fastener, having an opposing flat surface portions having a male fastener element and a female fastener element are attached to the flat surface portions, respectively, the male fastener element and the female fastener element being engaged with or disengaged from each other to thereby open or close an opening of a seal-opened packaging bag, wherein pick-up tabs are provided on outer surfaces of the flat surface portions at portions corresponding to or near the male fastener element mounting portion and female fastener element mounting portion so as to project outward.

In such a packaging bag with a fastener, the present invention is characterized in that the packaging bag is composed of a bag body and a spout unit fused to the bag body for taking out an inner content in the bag body therethrough, wherein the spout unit is provided with a pair of wall surface portions opposing to each other, a fastener composed of the male and female fastener elements provided in an opposing manner on inner surfaces of the paired wall surface portions, and the pick-up tabs formed on the outer surfaces of the wall surface portions, respectively, the wall surface portions, the fastener and the pick-up tabs being molded as one member by an injection molding process, and wherein the spout unit has one side, with the fastener being boundary, formed as a closed end closed so as to shut off an interior of the spout unit from an exterior thereof and another one side formed as an opened end, and seal-opening lines for the spout unit to be torn into the closed end side and the fastener side between the closed end and the fastener is formed on the wall surface portions.

The present invent ion is also characterized in that the bag body has a corner portion having insertion holes formed in flat surface portions of the bag body, respectively, the closed end side of the spout unit is directed outside and the opened end side thereof is directed inward, so that the pick-up tabs are inserted into the insertion holes from the inside of the bag body so as to project outward of the flat surface portions and a peripheral edge of the spout unit accords with a peripheral edge of the bag body, and the peripheral edges of the spout unit and the bag body are overlapped with each other and then sealed integrally.

On the other hand, there is provided a packaging bag with a fastener, wherein the female fastener element has a base portion, an insertion groove portion formed on one surface side of the base portion and the pick-up tab formed on another surface side of the base portion, the base portion, the insertion groove portion and the pick-up tab being molded integrally, and the male fastener element has a base portion, a projecting portion formed on one surface side of the base portion so as to be engaged with or disengaged from the insertion groove portion and the pick-up tab formed on another surface side of the base portion, the base portion, the projecting portion and the pick-up tab being molded integrally, wherein insertion holes are formed to the flat surface portions on the corner portion of the bag body, and wherein the male fastener element and the female fastener element are formed such that the respective pick-up tabs are inserted from the inside to the outside of the flat surface portions so as to project outward the flat surface portions, and the respective base portions are sealed to the inner surfaces of the flat surface portions.

Furthermore, the present invention provides the packaging bag with a fastener wherein the male fastener element has a base root portion having a constant thickness and an engaging portion formed to a front end portion of the base root potion so as to have a thickness larger than that of the base root portion so as to be engaged with or disengaged from the female fastener element, wherein the engaging portion has an asymmetric shape, in cross section with respect to a center line in the thickness direction of the base root portion, having one side relatively largely protruded outward and another side protruded to be relatively small with respect to the one side, wherein the female fastener element has a seat portion having a constant thickness and a pair of groove walls extending from the seat portion, and an engagement groove formed between the groove walls, the engagement groove being engaged with or disengaged from the engaging portion of the male fastener element, wherein an inner surface of one of the groove walls corresponding to one side of a contour of the engaging portion engaged with the engagement groove is formed to be relatively deeply recessed outward with respect to the center line in the thickness direction of the seat portion, and an inner surface of the another groove wall corresponding to another side of the contour of the engaging portion is formed to be relatively shallowly recessed outward with respect to the center line in the thickness direction of the seat portion so as to provide an asymmetric shape with respect to the center line, and wherein one of the male fastener element and the female fastener element is provided inwardly of the packaging bag with a fastener and another one thereof is provided outwardly thereof.

In the above embodiment:

a contour of one side of the engaging portion of the male fastener element is formed with a circular-arc portion protruded in a circular-arc shape from a boundary portion of the base root portion toward a front end portion of the engaging portion itself, and a portion to be engaged is formed to the boundary portion between the circular-arc portion and the base root portion so as to project outward from the side surface of the base root portion at the boundary portion, the contour of the other side of the engaging portion is formed with a mount-shaped portion protruded in a mount-shape from the side surface of the base root portion toward the outside and an oblique portion extending linearly toward the front end of the engaging portion itself from the mount-shaped portion, the groove walls of the female fastener element has a distance gradually widened toward the front end sides thereof, the one of the groove walls has a circular-arc portion formed in a circular-arc shape from the seat portion toward the front end portion and a first engaging pawl projecting relatively largely toward the center of the female fastener element from the front end of the circular-arc portion so as to be engaged with the portion to be engaged, and the other one of the groove walls has an oblique portion extending linearly from a root portion toward the front end and a second engaging pawl relatively finely projecting toward the center of the female fastener element from the front end of the oblique portion so as to be engaged with the mount-shaped portion.

Furthermore, in the present invention, a groove portion is formed to the front end of the male fastener element so as to extend in the axial direction of the male fastener element, and with the male fastener element and the female fastener element engaged each other, a space is formed between the front end portion of the male fastener element and a groove bottom of the engaging groove formed to the female fastener element so as to be engaged with the male fastener element.

Benefits of the Invention

According to the present invention, for the packaging bag sealed by a fastener provided for the packaging bag, the fastener is easily disengaged by picking up a pick-up tab. Particularly, for a packaging bag having a small spout opening formed after tearing a seal-opening line, it was difficult to release the fastener in a conventional art. However, the present invention makes it possible to easily release the fastener by providing the pick-up tabs, so that even in a packaging bag having a small spout opening, the fastener is easily released. This matter may provide an effect of increasing design freedom for a size of a spout opening to be formed by tearing the seal-opening line.

In the present invention, there is adopted a fastener having asymmetric structure with respect to the center line of the fastener elements when the male fastener element and the female fastener element are engaged. Because of this reason, there causes a difference in an engaging force of the male and female fastener elements between one and other sides with respect to the center line. That is, the engaging force is larger, in the one side which is formed so as to relatively largely project outward, than that in the other side.

On the other hand, in the packaging bag with a fastener according to the present invention, in relation to the fastener attaching condition, when the fastener is disengaged, moment is applied to the fastener with the outside of the fastener being fulcrum. In such a packaging bag with a fastener, since one side having a large engaging force of the packaging bag is attached so as to be directed inward of the packaging bag, the fastener is easily disengaged.

Furthermore, in the packaging bag with a fastener according to the present invention, the fastener is hard in comparison with an ordinal one. Because of this reason, if powdered inner content adheres to the fastener, it may become difficult to easily perform the engagement or disengagement of the fastener. In order to eliminate such defect, a groove is formed to the front end of the male fastener element, and in such structure, the inner content is accommodated in this groove so that the inner content does not disturb the engagement and disengagement of the fastener.

EXPLANATION OF REFERENCE NUMERALS

Figure 1:
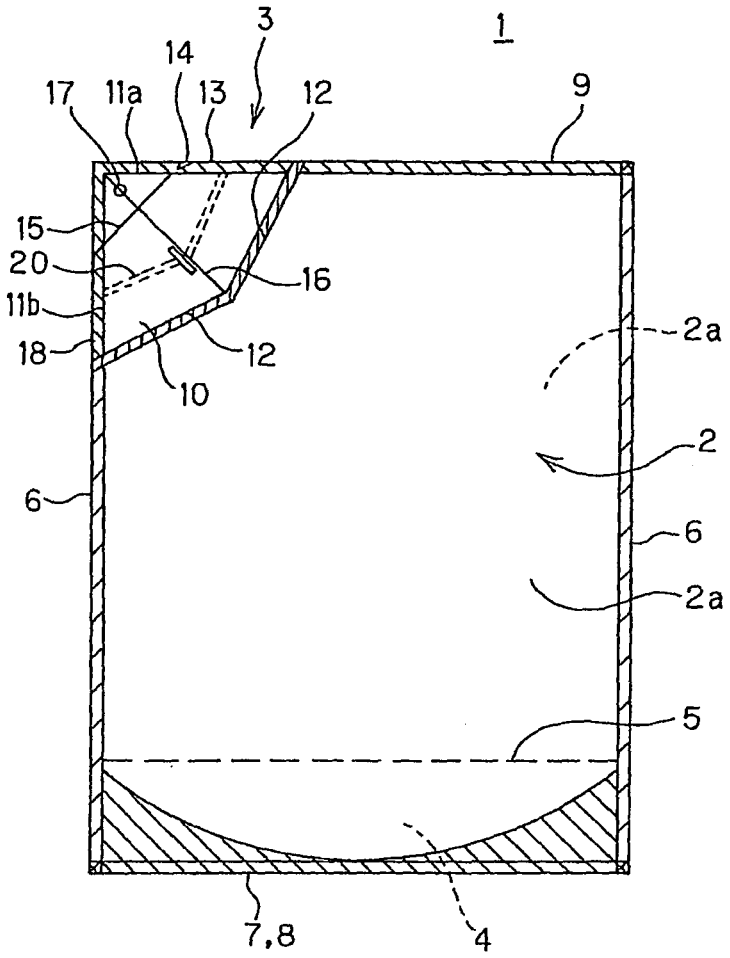
FIG. 1 is a front view of a standing pouch according to an embodiment of the present invention.

1, 1A, 80 - - - standing pouch (packaging bag provided with fastener)
100 - - - packaging bag with fastener
2, 101 - - - bag body
3, 3A - - - spout unit
70 - - - connection opening
10 - - - wall surface portion
11*a*, 11*b* - - - side edge
12 - - - bottom portion
13, 18 - - - seal margin
14, 108 - - - notch
15, 107 - - - seal-opening line
16 - - - central folded line
20, 30, 110 - - - fastener
21, 31, 120 - - - male fastener element
25, 35, 130 - - - female fastener element
40, 41 - - - pick-up tab
124, 134 - - - pick-up tab
51, 141 - - - insertion hole
150, 155 - - - pick-up tab
153, 159 - - - thickened portion
160 - - - male fastener element
161 - - - base root portion
164 - - - circular-arc portion
165 - - - portion to be engaged
167 - - - mount-shaped portion
168 - - - oblique surface portion
169 - - - groove
170 - - - female fastener element
171 - - - seat portion
172, 175 - - - groove wall
173 - - - circular-arc portion
174 - - - first engaging pawl
176 - - - inclination
177 - - - second engaging pawl
179 - - - engagement groove

BEST MODE FOR EMBODYING THE INVENTION

Hereunder, exemplary embodiments of the present invention will be described with reference to the accompanying drawings.

FIG. 1 is a front view of a standing pouch 1 as a packaging bag provided with a fastener according to one embodiment of the present invention. The standing pouch 1 is composed of a bag body 2 and a spout unit 3 that is fused to the bag body 2 and is adapted to pour out inner content. The bag body 2 is formed from a pair of opposing flat surface portions 2*a* and a bottom surface portion 4. The flat surface portions 2*a* are formed so as to have a tubular shape by heat-sealing side edges 6 of both the flat surface portions 2*a*. The bottom surface portion 4 is folded in V-shape such that a folded line 5 formed at the central portion of the V-shaped bottom surface portion 4 is directed upward of the standing pouch 1. Furthermore, the lower end edges 7 of the paired flat surface portions 2*a* and the peripheral edge 8 of the bottom surface portion 4 are heat-sealed so as to provide an elliptical shape when the bottom surface portion is developed.

The bog body 2 is formed of the following laminate film.

ON 15/DL/L-LDPE 50-100
ON 25/DL/CPP 50-100
PET 12/PRINT/DL/ON 15/DL/L-LDPE 50-100
PET 12/PRINT/DL/ON 15/DL/CPP 50-100
PET 12/PRINT/DL/AL6-12/DL/ON 15/DL/L-LDPE 50-100
PET 12/PRINT/DL/ON 15/DL/AL6-12/DL/CPP 50-100

The respective marks used herein mean the followings.

ON: biaxial elongation nylon
DL: dry laminate
L-LDPE: straight-chain low-density polyethylene
PET: polyethylenetelephtalate
CPP: non-extension polypropylene Further, " " means m. For example, 15 means 15 m.

Further, the spout unit 3 is attached to the corner portion of the upper portion of the bag body 2. The spout unit 3 has a pair of opposing wall surface portions 10 on the inner surfaces of which fasteners 20 are provided, and on outer surfaces of which pick-up tabs are provided. Each of the respective wall surface portions 10 has a rectangular shape having four sides, forming periphery thereof, including long two sides 11 and short two sides forming bottom portions 12. Under the state that the respective wall surface portions 10 are overlapped, the long sides 11 are directed outward the standing pouch 1 and mated with the peripheral edge of the bag body 2, while the bottom portions 12 formed from the short sides are directed inward the standing pouch 1. The spout unit 3 attached to the corner portion is sealed to the sides 11 at its wall surface portions 10 and thus closed. At the bottom portions 12, the wall surface portions 10 are separated and opened so that the interior of the bag body 2 and the inside of the bag body 2 communicate with each other.

Figure 2:
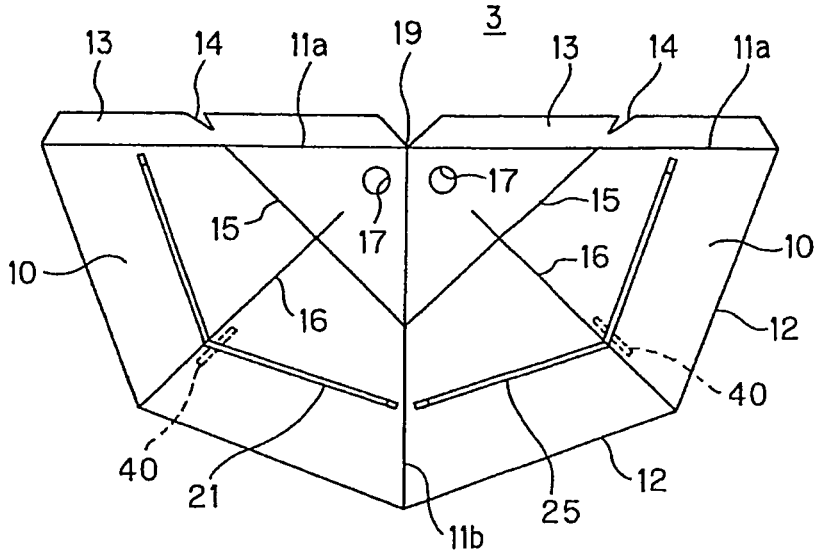
FIG. 2 is a plan view illustrating a developed state of a spout unit used for the standing pouch of FIG. 1.
Figure 3:
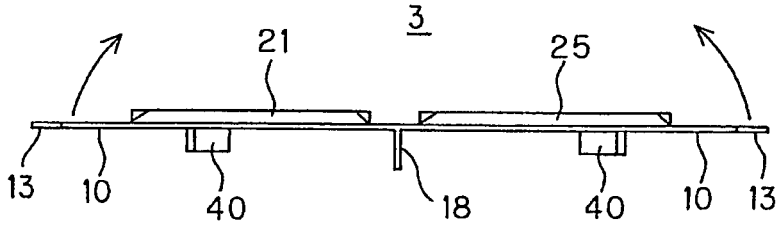
FIG. 3 is a side view viewed from the bottom portion of the spout unit of FIG. 2.
Figure 4:
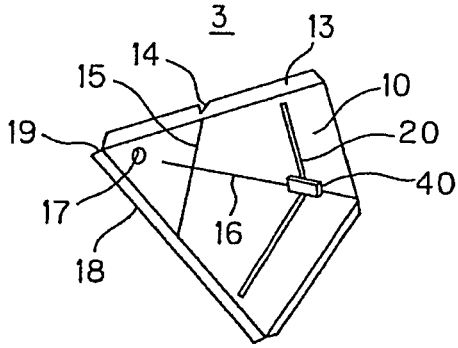
FIG. 4 is a perspective view illustrating a state in which the spout unit is folded and wall portions thereof are overlapped.

FIGS. 2 to 4 illustrate the details of the spout unit 3, in which FIGS. 2 and 3 are developed views of the spout unit 3, and FIG. 4 is a perspective view illustrating the state that the respective wall portions 10 are overlapped. The spout unit 3 is molded by an injection molding process as one member including the wall surface portions 10, the fasteners 20, the seal margins 13, 18 and the pick-up tags 40 in the developed state illustrated in FIGS. 2 and 3.

Each of the wall surface portions 10 formed into quadrangular shape has long side edges 11*a*, 11*b* orthogonal to each other, and one wall surface portion 10 is connected at one 11*b* of these long side edges 11*a*, 11*b* so that this one 11*b* of the long side edges is formed as the side edge portion of the wall surface portion 10. The other side edges 11*a* form a straight line so as to be orthogonal to the side edge 11*b*. Seal margins 13, each having a constant width and protruding outward, are formed along the end edges of the wall surface portions 10 of the side edges 11*a* forming both end portions. Likewise, a seal margin 18, having a constant width and protruding outward, is formed as illustrated in FIG. 3 at the central side edge 11*b* connecting the respective wall surface portions 10. Further, the respective wall surface portions 10 are formed with central foldable lines 16 for folding the wall surface portions 10 at portions forming the center lines of the respective wall surface portions 10 connecting the apex portion 19 of the spout unit 3 forming the intersecting point of the side edges 11*a*, 11*b* and the intersecting point of the bottom portion 12.

Then, on the inner surface of each of the wall surface portions 10, the male fastener element 21 is provided, and on the inner surface of the other wall surface portion 10, the female fastener element 25 is provided. These male and female fastener elements 21 and 25 are bent at the central portion of each wall surface portion 10 so as to be parallel with the bottom portion 12 to keep a constant distance from the bottom portion 12.

Figure 5:
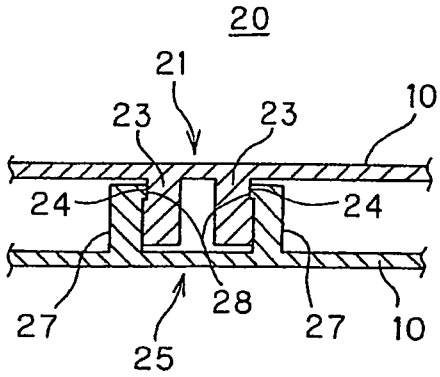
FIG. 5 is a view illustrating a fastener having male and female fastener elements engaged with each other.
Figure 6:
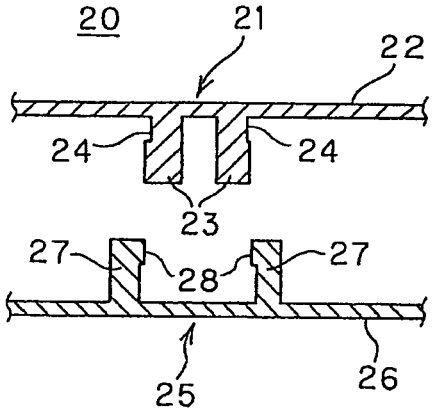
FIG. 6 is a view illustrating a fastener having male and female fastener elements separated from each other.

FIGS. 5 and 6 illustrate details of the fastener 20. These FIGS. 5 and 6 illustrate cross sectional views of the male fastener element 21 and the female fastener element 25, in which FIG. 5 illustrates a state of the male and female fastener elements being engaged and FIG. 6 illustrates a state of these fastener elements being separated.

The male fastener element 21 is composed of a pair of engaging pawls 23 projecting from the inner surface of the wall surface portion 10 so as to be perpendicular thereto. These engaging pawls 23 are parallel with each other with a constant distance along the entire length direction thereof. These engaging pawls 23 have root portions to the outer surface of which grooves 24 are formed so as to extend along the entire direction thereof. On the other hand, the female fastener element 25 is composed of a pair of engaging walls 27 projecting from the inner surface of the wall surface portion 10 so as to be perpendicular thereto. These engaging walls 27 have a distance therebetween so as to correspond to a dimension between outer surfaces of the engaging pawls 23 so that the male fastener element 21 is inserted. Pawls 28 are formed respectively to the front ends of the engaging walls 27 so as to project inward. These pawls 28 are engageable with the grooves 24 formed to the root portions of the engaging pawls 23 forming the male fastener element 21.

As illustrated in FIG. 5, in the fastener 20, when the engaging pawls 23 of the male fastener element 21 are inserted between the engaging walls 27 of the female fastener element 25, the pawls 28 formed to the front ends of the engaging walls 27 are engaged with the grooves 24 formed to the root portions of the engaging pawls 23.

Figure 7:
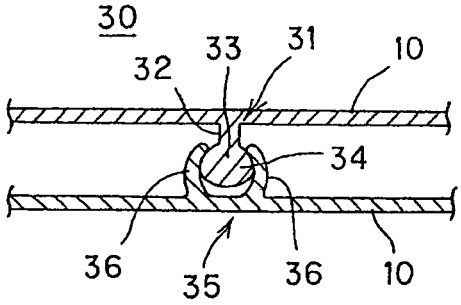
FIG. 7 illustrates a fastener according to an embodiment other than the fastener illustrated in FIGS. 5 and 6.

Further, as the fastener, a fastener 30 having a shape illustrated in FIG. 7 may be utilized. With reference to FIG. 7, a male fastener element 31 is provided with a single row of engaging projection 33 which projects from the inner surface of the wall surface portion 10. The engaging projection 33 has a root portion 32 formed into a flat plate shape normal to the wall surface portion 10, and a front end 34 of the projection 33 has substantially a circular cross section. On the other hand, a female fastener element 35 is provided with opposing paired engaging walls 36 projecting from the inner surface of the wall surface portion 10. The engaging walls 36 forming the female fastener element 35 have a circular-arc cross section with a circular-arc space between the engaging walls 36. In the fastener 30, as illustrated in FIG. 7, the male and female fastener elements 31 and 35 are engaged by inserting the front end 34 of the engaging projection 33 forming the male fastener eminent 31 between the engaging walls 36 of the female fastener element 35.

Further, a pick-up tab 40 is provided to the outer surface of each of the wall surface portions 10 (refer to FIGS. 2 to 4). The pick-up tab 40 is formed so as to project from the outer surface at a portion just near the side portion of the center foldable line 16. The pick-up tab 40 is formed to be parallel with the center foldable line 16 at a position corresponding to an intermediate portion in an extending direction of the center foldable line 16.

Furthermore, the spout unit 3 is provided with seal-opening lines 15 at area of the wall surface portions 10 between the apex 19 as an intersecting point of the side edges 11*a*, 11*b* and the fastener 20 so as to separate the apex 19 side from the spout unit 3 by tearing and opening the seal-opening line 15. This seal-opening line 15 is perpendicular to the center foldable line 16, and is formed so as to connect the side edges 11*a*, 11*b* of the respective wall surface portions 10. Further, the seal margin of the side edge 11*a* is formed with a notch 14 at a position corresponding to the end portion of the seal-opening line 15 so as to easily open the line 15. Further, in this embodiment, an example in which the notch 14 is formed as tearing starting portion is illustrated, but the present invention is not limited to such example. For example, a so-called rough surface portion, having a thin thickness or formed of a coagulation of fine holes, may be formed to a portion existing on the same line as the seal-opening line 15.

At portions near the apex 19 of the respective wall surface portions 10, there are formed circular through holes 17. The through holes 17 are formed to portions at which stock bar of a part-feeder for feeding the spout units 3 one by one to a film material at a time when the spout units 3 are fed to the film material forming the bag body 2 is inserted.

As mentioned above, the spout unit 3 is folded at the side edge 11*b* connecting the wall surface portions 10 together and overlapped in a state such that the inner surfaces on which the fasteners 20 are formed are opposed. FIG. 4 illustrates the state that the respective wall surface portions 10 are folded in an overlapped state.

Figure 8:
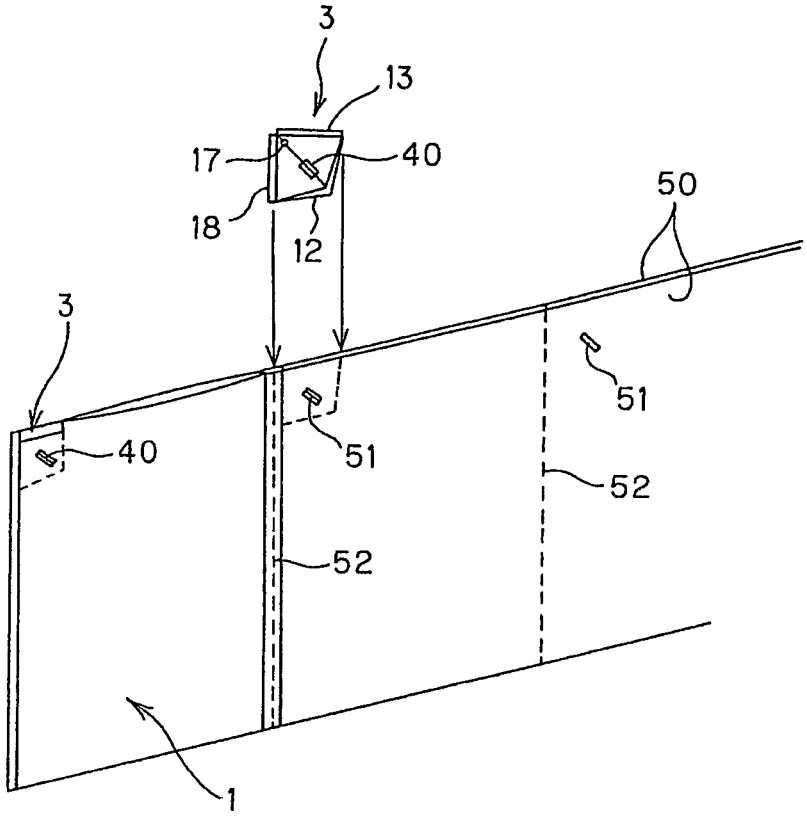
FIG. 8 is a view illustrating a process for feeding a film material to the spout unit.
Figure 9:
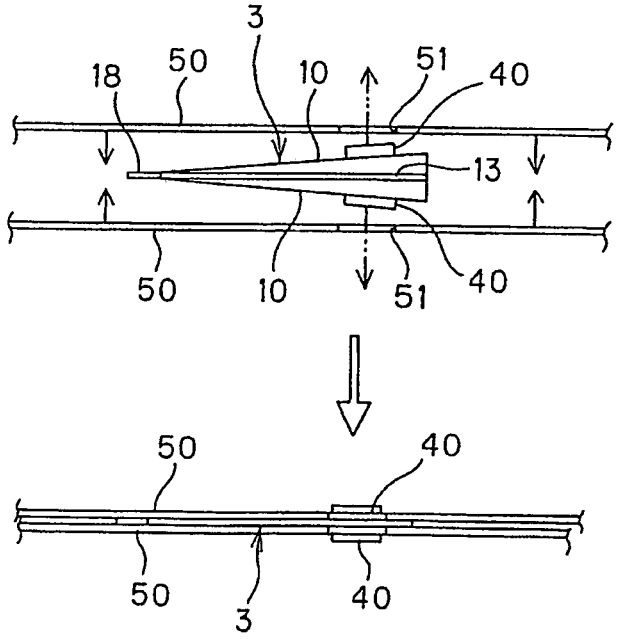
FIG. 9 is a view illustrating a process for heat-sealing the spout unit to the film material.
Figure 10:
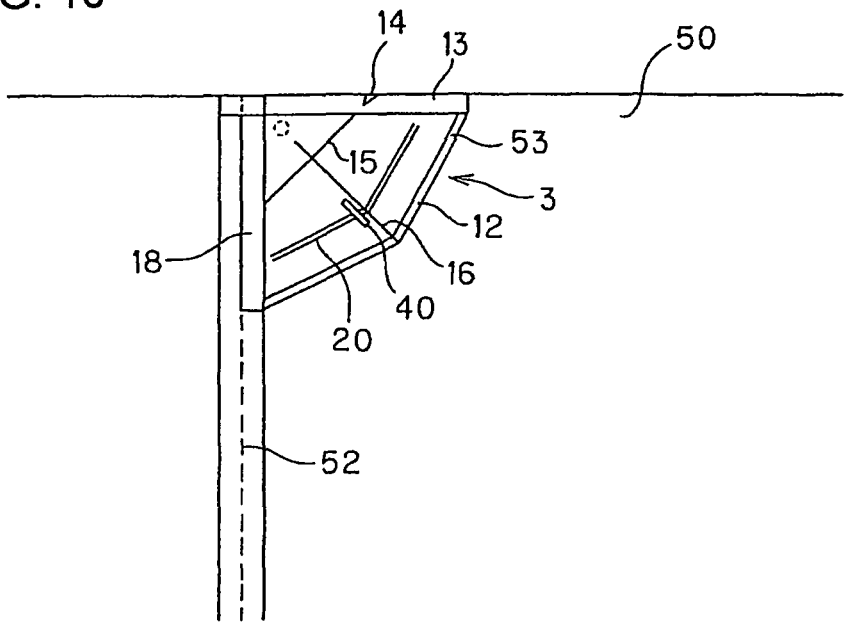
FIG. 10 is a view illustrating a state in which the spout unit is heat-sealed to the film material.

Such a spout unit 3 is mounted to the bog body 2 as illustrated in FIGS. 8 to 10.

Belt-shaped film materials 50 forming as flat surface portions 2*a* of the bag body 2 are opposed, as illustrated in FIG. 8, and delivered in its longitudinal direction. A dimension of the standing pouch 1 is decided by coinciding the width direction thereof with the longitudinal direction of the film material 50. In FIG. 8, a boundary between the standing pouches 1 is indicated by a broken line 52. Insertion holes 51, through which the pick-up tabs 40 formed to the outer surfaces of the respective spout units 3 are inserted, are formed at a constant interval from each other at the upper portions of the film materials 50.

These insertion holes 51 are respectively formed at the positions corresponding to corner portions on the upper portion side of the standing pouches 1. Each insertion hole 51 is formed so as to have a shape corresponding to the outer shape of the pick-up tab 40 of the spout unit 3. Further, the insertion hole 51 is formed at such a position as that the positional relationship between the upper end edge of the film material 50 and the boundary of the standing pouches 1 indicated by the broken line 52 corresponds to the positional relationship between the both side edges 11*a*, 11*b* of the spout unit 3 and the pick-up tab 40.

The spout unit 3 is fed toward the portions at which the insertion holes 51 are formed with respect to the conveying film materials 50. In this operation, the spout unit 3 is fed, as illustrated in FIG. 4, in a state that the wall surface portions 10 thereof are overlapped with each other, and the male fastener element 21 and the female fastener element 25 formed to the inner surfaces of the wall surface portions 10 are engaged with each other. FIG. 9 illustrates a state in which the spout unit 3 is inserted between the film materials 50. When the spout unit 3 is inserted between the film materials 50, the pick-up tabs 40 formed on the outer surface of the spout unit 3 are inserted into the insertion holes 51 from the inside thereof so as to project outward from the film materials 50.

The insertion hole 51 has a shape and a positional relationship with respect to the film material 50 as mentioned above, so that when the pick-up tabs 40 are inserted into the insertion holes 51, as illustrated in FIG. 10, the end edges of the seal margins 13 and 18 of the spout unit 3 necessarily accord with the upper end edge of the film material 50 and the boundary line 52 thereof. As mentioned, the insertion hole 51 has a function of positioning the spout unit 3 at the time of mounting the spout unit 3.

After the pick-up tabs 40 are inserted into the insertion holes 51 and the spout unit 3 is aligned in position, the film materials 50 are heat-sealed along the boundary line of each of the standing pouch 1. According to such heat-sealing operation, the inner surfaces of the film materials 50 and the seal margin 18 formed to one side edge 116 constituting the spout unit 3 are integrated. At the same time, the upper end edges of the film materials 50 and the seal margin 13 formed to the other end edge ha of the spout unit 3 are heat-sealed at only the portion corresponding to the seal margin 18 and then integrated. According to such operation, the corner portion is sealed. Further, the engaging pawl 23 of the male fastener element 21 and the engaging wall 27 of the female fastener element 25 does not create any unnecessary space between both the wall surfaces 10 at the positions of the seal margins 13 and 18 at the time of heat sealing because they are chamfered at both ends in the axial direction.

At the same time of the seat-sealing process, at the bottom portion 12 of the spout unit 3 directed inward of the packaging bag, the outer surface of the bottom portion 12 is heat-sealed to the inner surface of the film materials 50 along the end edges of the bottom portion 12. This portion is a belt-shaped portion denoted by reference numeral 53 in FIG. 10. The heat-seal portion of the bottom portion 12 is sealed at a temperature lower than the heat-sealing temperature for the seal margins 13 and 18, and both the bottom portions 12 of the film materials 50 are hence not heat-sealed together, and only the film materials 50 and the bottom portions 12 of the spout unit 31 are heat-sealed.

Through the heat-sealing process of heat-sealing the spout unit 3 to the film materials 50, the spout unit 3 is mounted to the film materials 50. Then, at the lower side end edges of the film materials 50, the film materials 50 and the bottom portions are heat-sealed, thus sealing the lower portion of the spout unit 3. Then, at the boundary of the respective packaging bags, the film materials 50 are cut away successively to thereby form each standing pouch.

Further, in this process, the upper portion 9 of the standing pouch 1 is left opened except the mounting portion of the spout unit 3. Though this opened portion, an inner content is poured into the packaging bag. After the charging of the inner content, both the flat surface portions 2*a* at the opened upper portion 9 are heat-sealed and closed, thus completing the packaging bag illustrated in FIG. 1.

Figure 11:
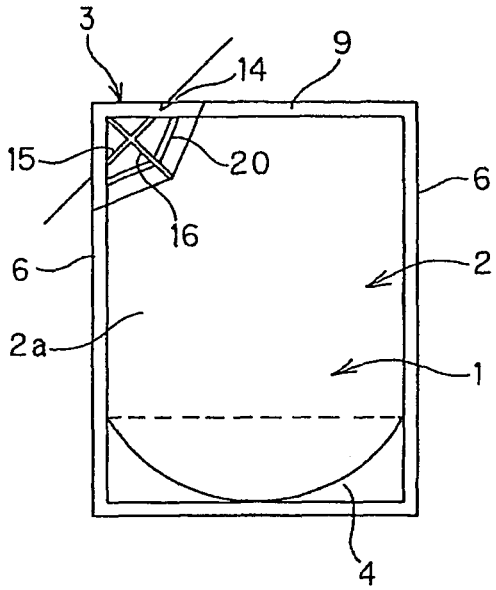
FIG. 11 is a view illustrating a state in which a seal-opening line is unsealed and an inner content is poured from the standing pouch.

In order to pour the inner content out of the packaging bag 1, as illustrated in FIG. 11, the spout unit 3 and the film materials 50 are torn along the seal-opening line 15 from the notch 14 to thereby form the opening 60. Then, the pick-up tabs projecting outward through the flat surface portions 2*a* are picked up, and the flat surface portions 2*a* are separated as indicated with arrows A in FIG. 11. In this manner, the engaged fastener 20 is easily disengaged. Next, as indicated with arrows B in FIG. 12, force is applied to the upper end and the side end of the standing pouch 1 in the mating direction thereof. Then, as illustrated in FIG. 13, the central folded lines 16 formed to the central portion of the wall surface portions 10 are folded and bent outward, and the spout unit 3 is maintained in its four-sided pyramid-cone shape. At the same time, the opening portion 60 is also maintained in its quadrangle shape.

As mentioned above, by maintaining the spout shape, the inner content is easily poured out. Further, the flat surface portions 2*a* of the bag body 2 and the bottom portions 12 of the spout unit 3 are heat-sealed, so that when the inner content is poured out, it is not invaded from the bottom portions 12 of the spout unit 3 and does not leak out.

Figure 12:
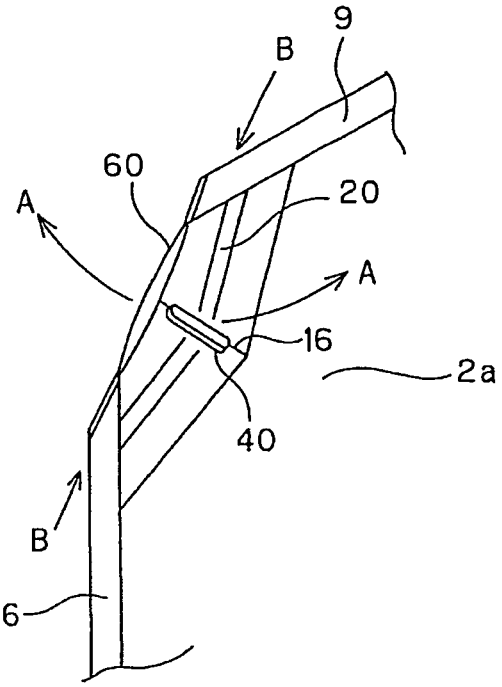
FIG. 12 is a perspective view of a portion near the opening illustrating a state that the sealed opening is unsealed.
Figure 13:
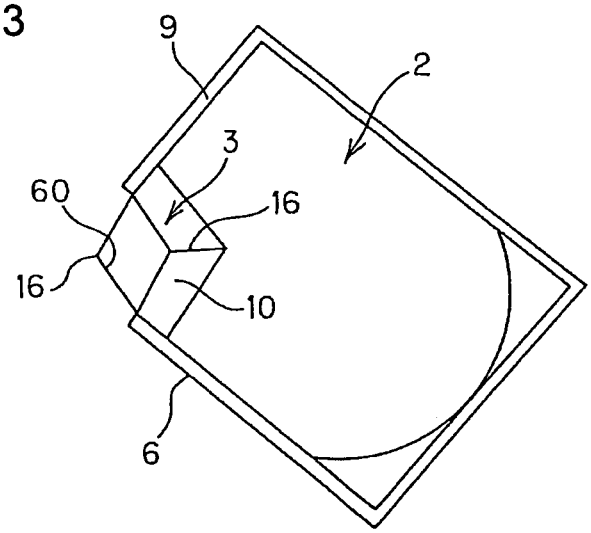
FIG. 13 is a perspective view illustrating a condition of the standing pouch from which the inner content is poured.

After the opening portion 60 is once closed by closing the fastener 20, when the opening portion 60 is again opened, the operations reverse to those in the opening process illustrated in FIG. 12 will be performed.

In the above, although the example of the standing pouch 1 was explained, the present invention is not limited thereto and, for example, the present invention may be applied to a flat bag formed by bending the film material into two parts.

Further, the pick-up tab is not limited to one formed in parallel with the central folding line 16, and it may be formed by another mode.

Figure 14:
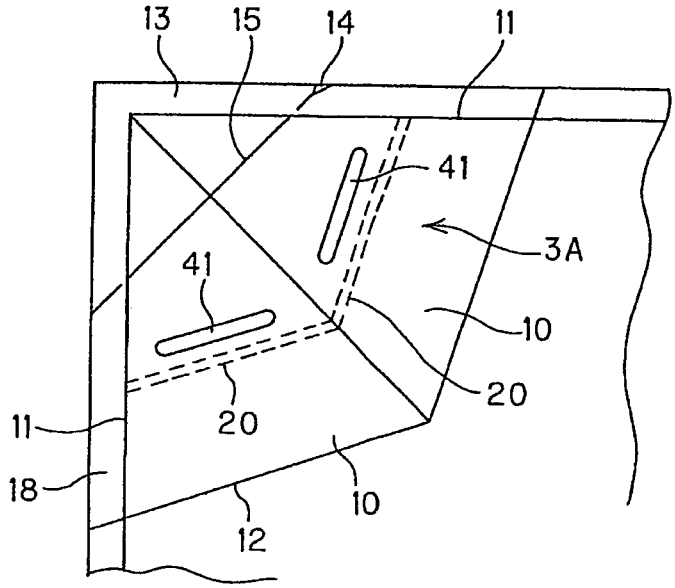
FIG. 14 is a plan view according to another embodiment.
Figure 15:
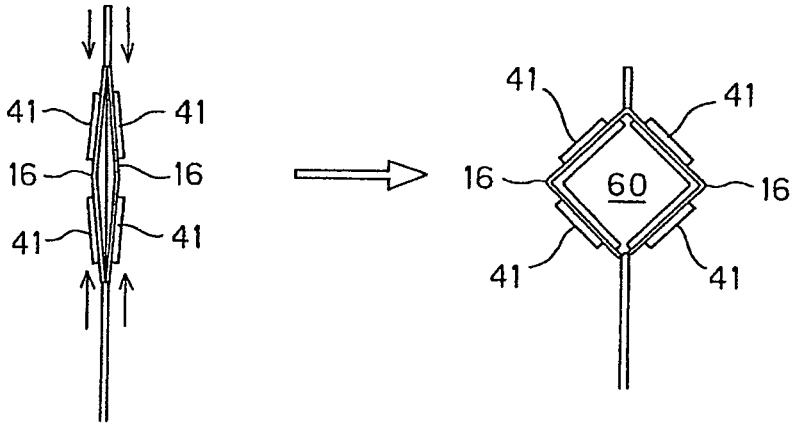
FIG. 15 is a view illustrating a state that the opening portion of the spout unit illustrated in FIG. 14 is opened.

FIG. 14 illustrates another example of forming a pick-up tab 41 in another mode. The example illustrated in FIG. 14 is provided with two pick-up tabs 41 to the respective wall surface portions 10. The pick-up tabs 41 formed to the respective wall surface portions 20 are parallel with the axial direction of the fastener 20 at symmetrical positions with respect to the central folding lines 16. When such pick-up tabs 41 are formed, insertion holes 51 for inserting the pick-up tabs 41 are formed to the flat surface portions 2*a* of the bag body 2 at positions corresponding to the locations of the pick-up tabs 41. According to these pick-up tabs 41, the fastener 20 are disengaged by picking up the pick-up tabs 41 in the direction to separate the wall surface portions 10, as well as by pushing the pick-up tabs 41 formed symmetrically with respect to the central folding line as the boundary in the facing direction as illustrated in FIG. 15.

Further, the connection structure of the spout unit 3 and the bag body 2 is not limited to the structure in which the spout unit 3 is arranged between both the flat surface portions 2*a* of the bag body 2 as mentioned above.

Figure 16:
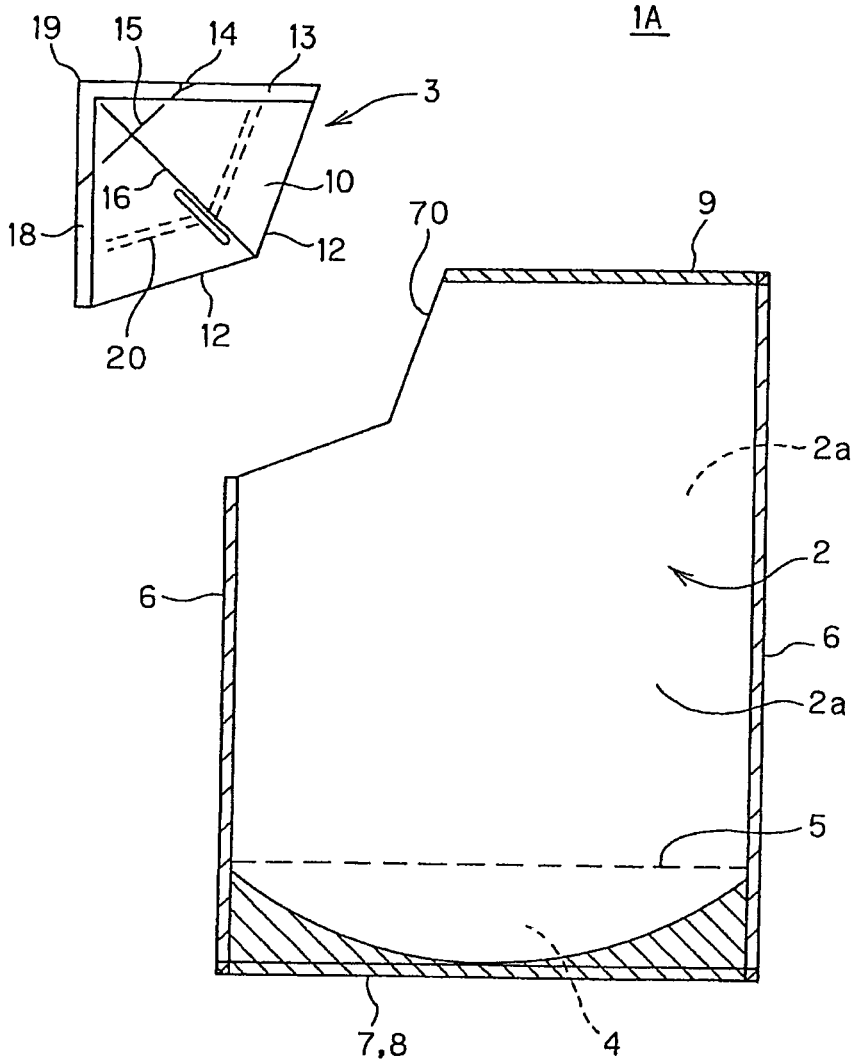
FIG. 16 is a plan view of a packaging bag provided with a fastener having a different connection structure between the spout unit and the bag body.

FIG. 16 illustrates a packaging bag according to another embodiment having different connection structure of the spout unit 3 and the bag body 2.

For this standing pouch 1A, the spout unit 3 is formed by overlapping the wall surface portions 10 and preliminarily heat-sealing the overlapped seal margins 13 and 18. Because of this reason, the peripheral edges around the apex 19 are closed with respect to the fastener 20. On the other hand, at the position of the bottom portion 12, the wall surface portions 10 are not sealed together and the spout unit 3 is opened. Further, a connection opening 70 is formed to the upper side corner portion of the bag body 2. The bottom portion 12 of the spout unit 3 is mated to this connection opening 70 so as to heat-seal both the portions to thereby complete the standing pouch 1A.

Figure 17:
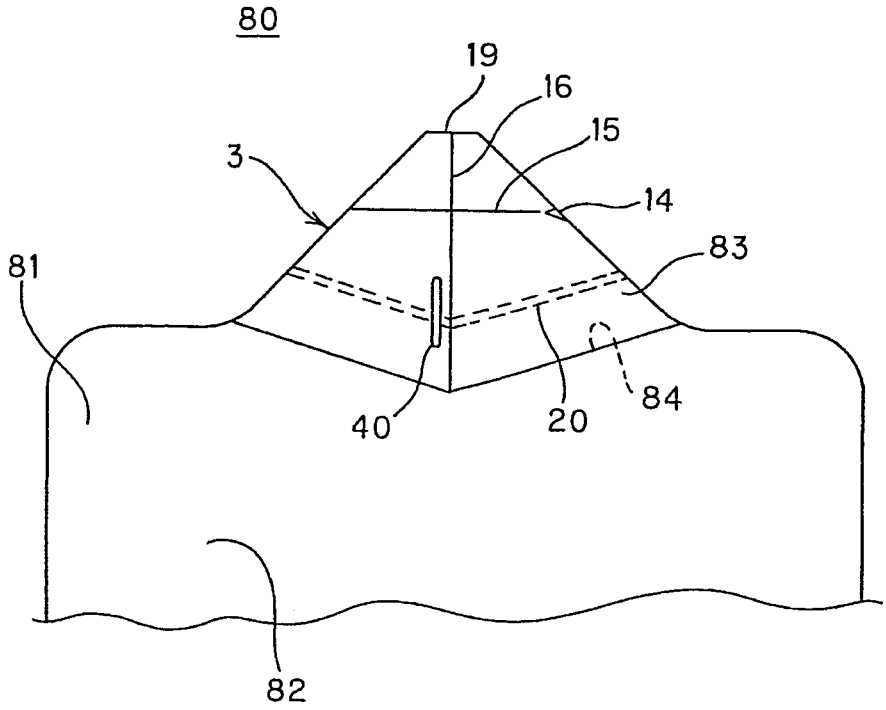
FIG. 17 is a view illustrating a portion near the spout unit of the packaging bag with a fastener in which the spout unit is attached to the center of the bag body in the width direction thereof.
Figure 18:
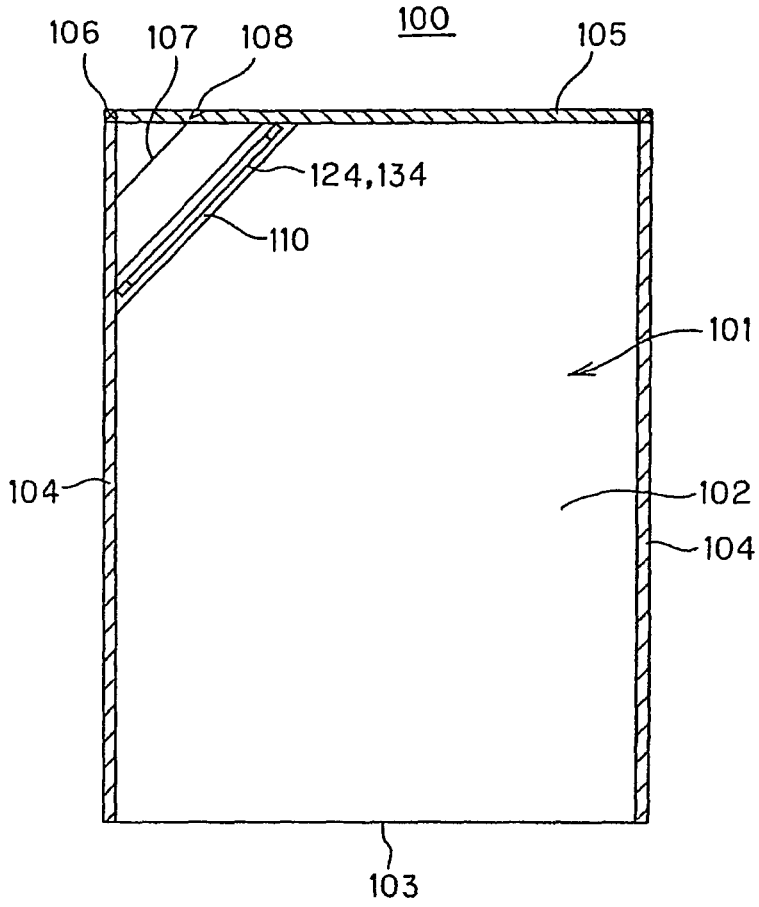
FIG. 18 is a plan view of a packaging bag with a fastener according to another embodiment of the present invention.

As mentioned above, although the present invention was described with reference to the structure in which the spout unit 3 is mounted to the corner portion of the packaging bag, the present invention is not limited to such structure, and as illustrated in FIG. 17, a packaging bag 80 with a fastener may be formed by arranging the spout unit at a central portion in the width direction of a bag body 81 of the packaging bag 80. In the packaging bag 80 with a fastener illustrated in FIG. 17, the upper end thereof is projected above at the central portion in the width direction thereof. This projected portion constitutes the spout unit 3. In this packaging bag 80 with a fastener, the apex 19 of the spout unit 3 is positioned at the central portion in the width direction of the bag body 81 to be laterally symmetrically. In this packaging bag, it may be also possible to arrange the spout unit 3 between flat surface portions 82 of the bag body 81 and connect both the peripheral edge portion of the spout unit 3 and the projected portion 83 of the bag body by means of heat-sealing, or may be possible to form a connection opening 84 to the upper portion of the bag body and connect the spout unit 3 to this connection opening 84.

Next, with reference to FIGS. 18 to 23, another embodiment, in which pick-up tabs are provided to the respective flat surface portions of the bag body without providing the spout unit, will be explained.

In a packaging bag 100 with a fastener according to this embodiment, the packaging bag 100 is composed of a bag body 101 and a fastener 110 provided to the upper corner portion. The bag body 101 includes a pair of flat surface portions 102 formed by folding and overlapping a single sheet of film material so as to oppose to each other. The folded line portion of the film material is formed as a bottom surface portion 103 of the bag body 101, and both the flat surface portions 102 are heat-sealed at the side edge portions 104 and the upper edge portions 105. The fastener 110 is composed of male and female fastener elements 120 and 130 attached to the inside surfaces of the flat surface portions 102, respectively, to be disengageable. This fastener 110 is disposed to the bag body 101 so as to constitute a triangular shape together with the upper edge portion 105 and the side edge portion 104.

A seal-opening line 107 is formed to the flat surface portion 102 so as to extend in parallel with the fastener 110 between this fastener 110 and the apex 106 of the corner portion of the bag body 101. A notch 108 is also formed to the upper edge portion 105 forming one end in the axial direction of the seal-opening line 107. The bag body 101 is separated by tearing this seal-opening line 107 into the fastener 110 side and the apex 106 side, and the torn portion is formed as an opening for pouring. This opening portion is opened or closed by means of the fastener 110.

In the packaging bag 100 with the fastener, pick-up tabs 124 and 134 are provided at portions of the respective flat surface portions 102 corresponding to the positions at which a male fastener element 120 and a female fastener element 130 are attached.

Figure 19:
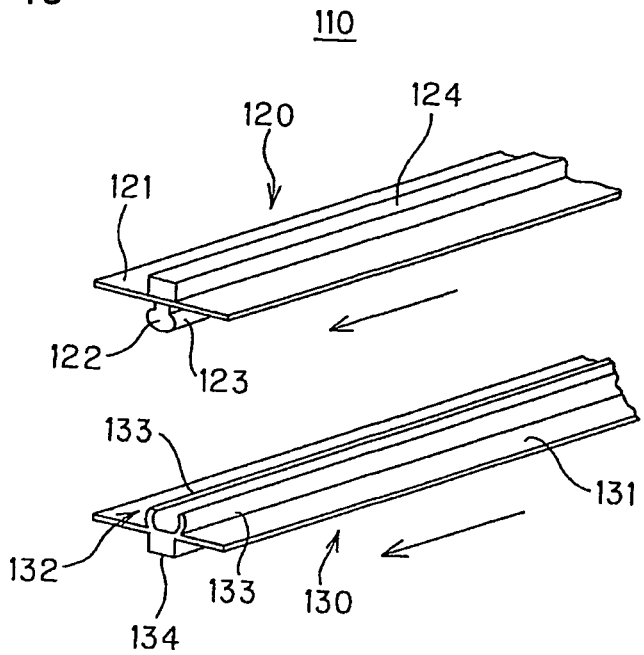
FIG. 19 is a perspective view of a fastener molded by an exclusion molding process.
Figure 20:
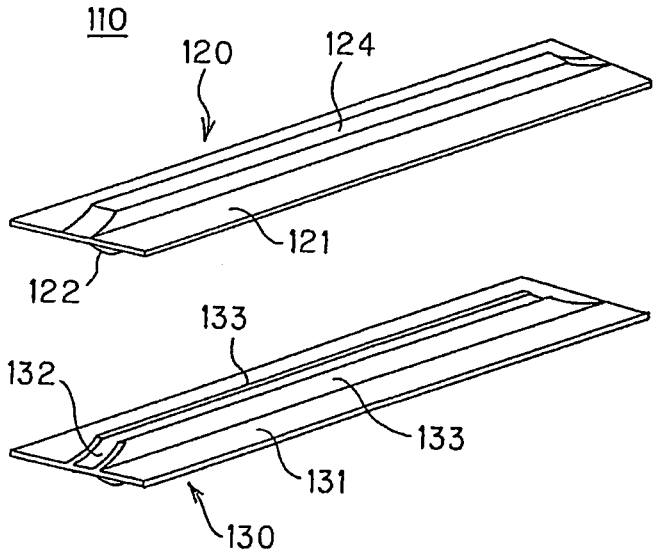
FIG. 20 is a perspective view of the fastener.

FIGS. 19 and 20 illustrate details of the fastener 110.

This fastener 110 is composed of the male fastener element 120 provided with a tape-shaped base portion 121 and an engaging projection 122 projecting from one surface of the base portion 121 and extending in the axial direction at the center in the width direction of the base portion 121, and the female fastener element 130 provided with a tape-shaped base portion 131 and an engaging groove extending on one surface of the base portion 131 in the axial direction at the center in the width direction of the base portion 131. The engaging projection 122 of the male fastener element 120 has a front end formed in a circular arc shape in section with a width wider than that at the root end thereof. On the other hand, the engaging groove 132 has a pair of groove walls projecting from one surface of the base portion 131 so as to extend in parallel with each other in the axial direction thereof.

A pick-up tab 124 is formed to the base portion 121 of the male fastener element 120 so as to project from the surface opposite to the surface on which the engaging projection 122 is formed and to extend in the axial direction at the center in the width direction of the base portion 121. Likewise, a pick-up tab 134 is formed to the base portion 131 of the female fastener element 130 so as to project from the surface opposite to the surface on which the engaging groove 132 is formed and to extend along the axial direction at the center in the width direction of the base portion 131.

The male fastener element 120 and the female fastener element 130 are molded, as illustrated in FIG. 19, by an extrusion molding process in which a resin material is applied to a mold, not illustrated, having a predetermined molding hole By molding the male fastener element 120 and the female fastener element 130 through such extrusion molding process, the male fastener element 120 is formed, as one member, so as to have the base portion 121, the engaging projection 22 and the pick-up tab 124, and the female fastener element 130 is formed, as one member, so as to have the base portion 131, the engaging groove 132 and the pick-up tab 134. The thus molded male fastener element 120 and the female fastener element 130 are successively cut, as illustrated in FIG. 20, at a suitable length so as to correspond to the packaging bag 100 to be used. The engaging projection 122 and the pick-up tab 124 are chamfered at both the axial end portions of the male fastener element 120. Likewise, the engaging groove 132 and the pick-up tab 134 are chamfered at both the axial end portions of the female fastener element 130.

As mentioned above, the pick-up tabs 124 and 134 are provided for the fastener 110, which is then mounted to the bag body 101. According to such structure, the fastener 110 is released by picking up the pick-up tabs 124 and 134 with fingers and separating the flat surface portions 102 from each other.

For the packaging bag 100 according to this embodiment, the fastener 110 is attached to the bag body 101 in the following manner.

Figure 21:
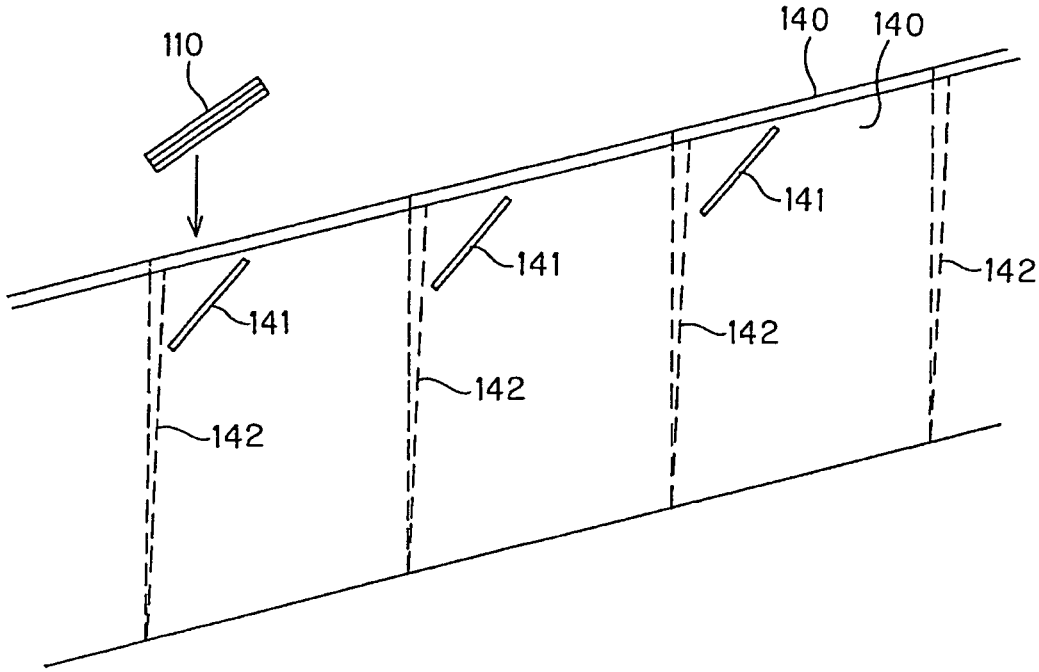
FIG. 21 is a view illustrating a process of feeding the spout unit to the film material.
Figure 22:
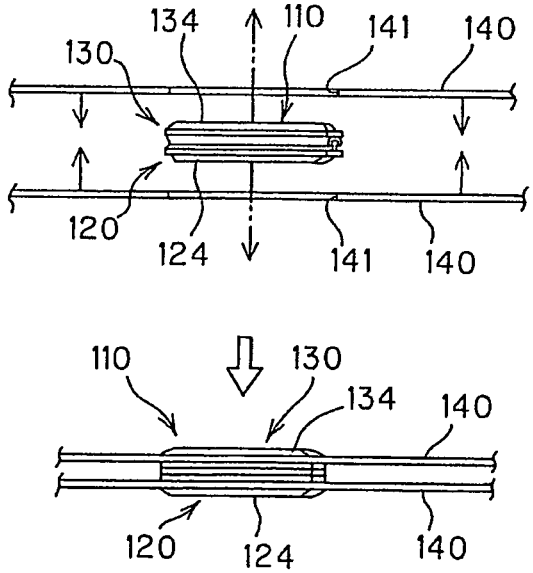
FIG. 22 is a view illustrating a heat-seal process for heat-sealing the fastener to the film material.

First, a belt-shaped film material 140 is folded into two parts at the central portion in the width direction thereof, and the folded film material 140 is conveyed in the longitudinal direction. Then, slender insertion holes 141 are formed at a constant interval to the conveyed film material 140. Broken line 142 indicated in FIG. 21 represents a portion formed as the side edge portion 104 of each packaging bag 100 at the time of completion as the packaging bag 100 with the fastener. The insertion hole 141 is formed in an inclined fashion so as to mutually communicate the upper edge portion and the broken line portion 142 at a portion near the upper edge portion and near a portion forming the side edge portion 104 of the packaging bag 100 indicated with the broken line 142.

The fastener 110 is inserted into a space between the film materials 140 from the upper side thereof in a state in which the male fastener element 120 and the female fastener element 130 are integrally engaged.

FIG. 20 illustrates a state that the fastener 110 is inserted between the film materials 140, in which the surfaces of the base portions 121 and 131 of the male and female fastener elements 120 and 130 on which the pick-up tabs 124 and 134 are formed are tightly contacted to the inner surfaces of the laminated film materials 140. At this time, the pick-up tabs 124 and 134 are inserted into the insertion holes 141 from the inside of the film materials 140 so as to project outward of the film materials 140. As in this embodiment, by forming the insertion holes 141 to the film materials 140 and inserting the pick-up tabs 124 and 134 into these insertion holes 141, the mounting portion and the orientation of the fastener 110 is decided.

In the next operation, the base portions 121 and 131 of the male and female fastener elements 120 and 130 and the film materials 140 tightly contacted to the base portions 121 and 131 are heat-sealed. The laminated film materials 140 are mutually heat-sealed at a portion indicated with broken line 142 therealong. At this time, the axial end portion of the fastener 110 is heat-sealed so as to be tucked by the film materials 140.

Figure 23:
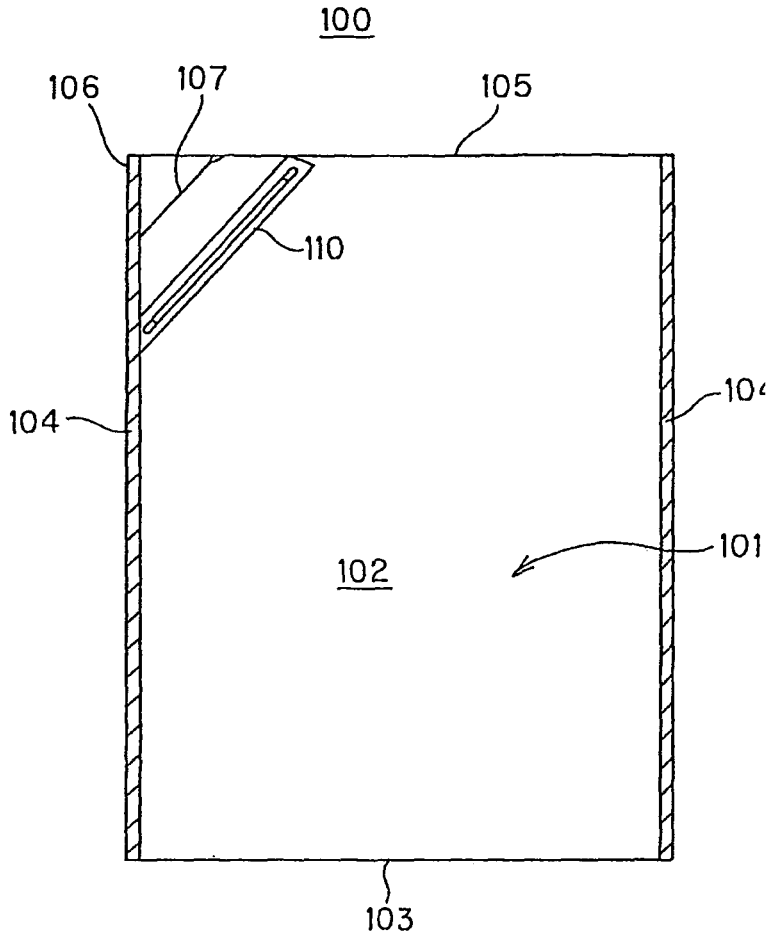
FIG. 23 is a plan view of the packaging bag with the fastener of a state in which the fastener is heat-sealed and the upper edge portion of the packaging bag is opened.

Thereafter, the film materials 140 are successively cut along the broken lines 142, thereby forming the packaging bag 100 with the upper edge portion 105 being opened (refer to FIG. 23). Then, an inner content is charged into the packaging bag body through the opened upper edge portion 105, and the flat surface portions 102 are then heat-sealed at the upper edge portions 105 to thereby complete the packaging bag 100. At the time when the upper edge portions 105 are heat-sealed, the film materials 140 are heat-sealed with the axial end portions of the fastener 110 are tucked.

By heat-sealing the base portions 121 and 131 entirely to the film materials 140, and tucking both the end portions of the fastener 110 between the film materials 140 and then heat-sealing them, formation of a space between the fastener 110 and the film material 140 are prevented to thereby surely prevent the inner content from leaking.

Further, in this embodiment, although the flat bag is explained, the present embodiment may be applied to a packaging bag such as standing pouch 1 in which a bottom member is sealed to a bottom portion of the flat surface portion 102.

Figure 24:
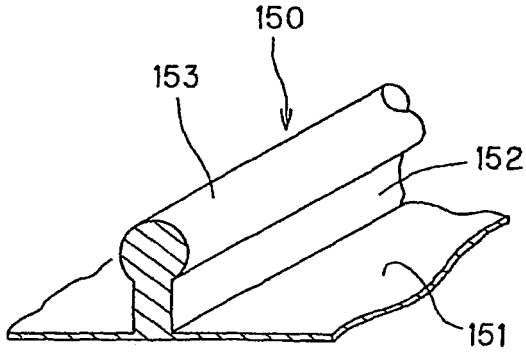
FIG. 24 is a perspective view illustrating one example of a pick-up tab having a thickened portion at the front end.
Figure 25:
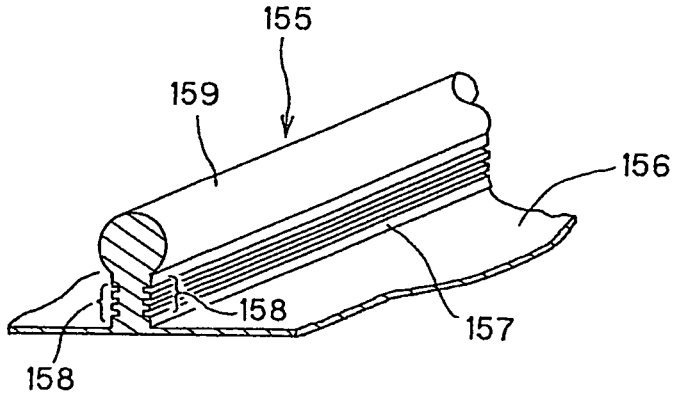
FIG. 25 is a perspective view illustrating one example of a pick-up tab having a slit formed to the root end thereof.

In the above, although the embodiment is described with reference to an example in which the pick-up tab has a thickness constant in a height direction along which the pick-up tab projects, the pick-up tab may be formed as illustrated in FIG. 24 or FIG. 25.

FIG. 24 illustrates one example of a pick-up tab 150 having a thickened portion at a front end in the height direction so as to provide a circular cross section. This pick-up tab 150 has a structure similar to the structure mentioned before in which the pick-up tab is formed so as to project from the base 151 such as outer surface of the flat surface portion of the spout unit or outer surface of the base portion of the fastener. This pick-up tab 150 has such characteristic feature as that a thickened portion 153 having thickness larger than that of a root portion 152 of the pick-up tab 150 is formed to the front end portion of the pick-up tab 150. The root portion 152 has a width constant from a boundary to the base 151 and a boundary to the thickened portion 153. On the other hand, the front end side thickened portion 153 has a circular cross section having a diameter larger than the thickness of the root portion 152.

As mentioned above, by forming the thickened portion 153 to the front end portion of the pick-up tab 150, when the pick-up tab 150 is picked up by fingers, the thickened portion 153 is engaged with the fingers, and accordingly, the pick-up tab is easily picked up. Further, in FIG. 24, although there is illustrated a pick-up tab having the circular cross section, the present invention is not limited to such shape, and rectangular shape, or other polygonal shape may be adopted.

FIG. 25 represents anther example of the pick-up tab 155. This pick-up tab also projects from a base 156, and the front end thereof is formed with a thickened portion 159. The thickened portion 159 has a circular cross section having a diameter larger than a thickness of a root portion 157. In this pick-up tab 155, a plurality of slits 158 are formed on both side surfaces of the root portion 157 to be parallel in the height direction of the pick-up tab 155 so as to extend along the axial direction thereof. These slits 158 may achieve slip-prevention function of the pick-up tab 155 when it is picked up with fingers.

Further, in either one of the pouring unit or fastener, when the pick-up tab projects outward from the inside of the bag body, it may be necessary, in consideration of the thickness of the bag body, to set an interval between the lowermost slit 158 and the base 156 so as to provide a distance more than this thickness.

According to the pick-up tab 155 illustrated in FIG. 25, when the pick-up tab 155 is picked up with fingers to open the sealed packaging bag, the fingers are engaged with the front end side thickened portion 159 and are prevented from slipping from the pick-up tab by the formation of the slits 158, and accordingly, the pick-up tab is further easily picked up and the packaging bag is more easily opened.

As mentioned above, the present invention is applicable to a packaging bag with a fastener of the structure in which the pick-up tab is provided to a member other than the bag body such as spout unit or fastener, the insertion hole is formed to the flat surface portion of the bag body, and the pick-up tab provided for the other member is inserted from the inside the bog body so as to project outward therefrom, and also applicable to a packaging bag with a fastener of the structure in which a connection opening is formed to the spout unit, a pick-up tab is provided by connecting the bottom portion of the spout unit to the connection opening, and a wall surface portion of the spout unit itself is formed as a portion of the flat surface portion of the bag body.

Of course, at a portion to which the fastener is formed or near, the pick-up tab may be formed directly to the flat surface portion of the bag body.

Then, in order to smoothly perform the engagement or disengagement of the fastener, and surely maintain the engagement, there may be provided fasteners mentioned hereunder.

Figure 26:
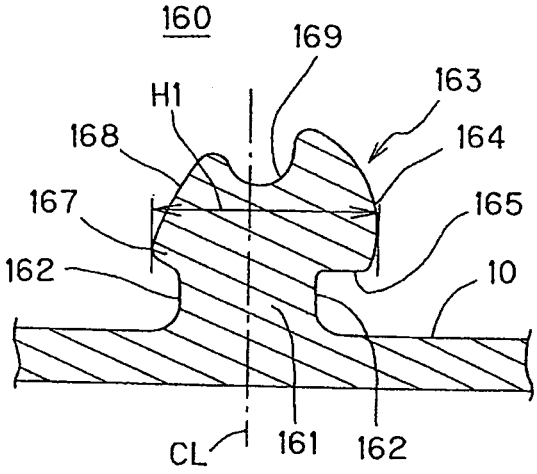
FIG. 26 is a cross-sectional view of a male fastener element used for the packaging bag provided with the fastener according to the present invention.
Figure 27:
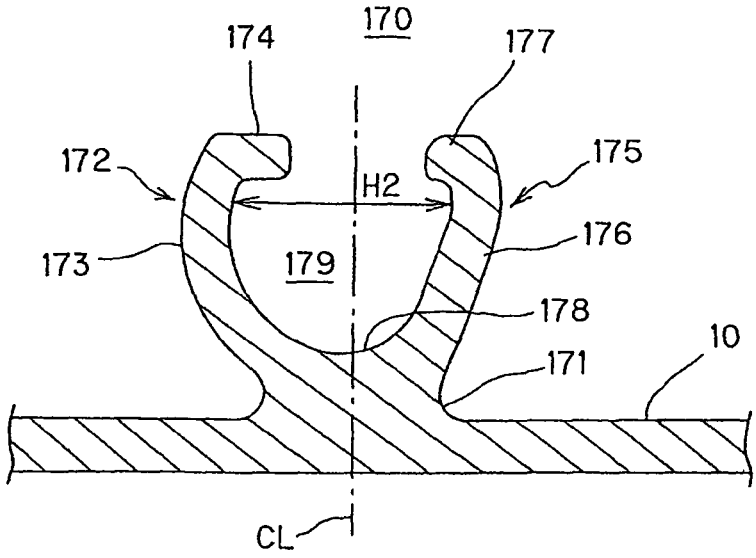
FIG. 27 is a cross-sectional view of a female fastener element used for the packaging bag with the fastener according to the present invention.
Figure 28:
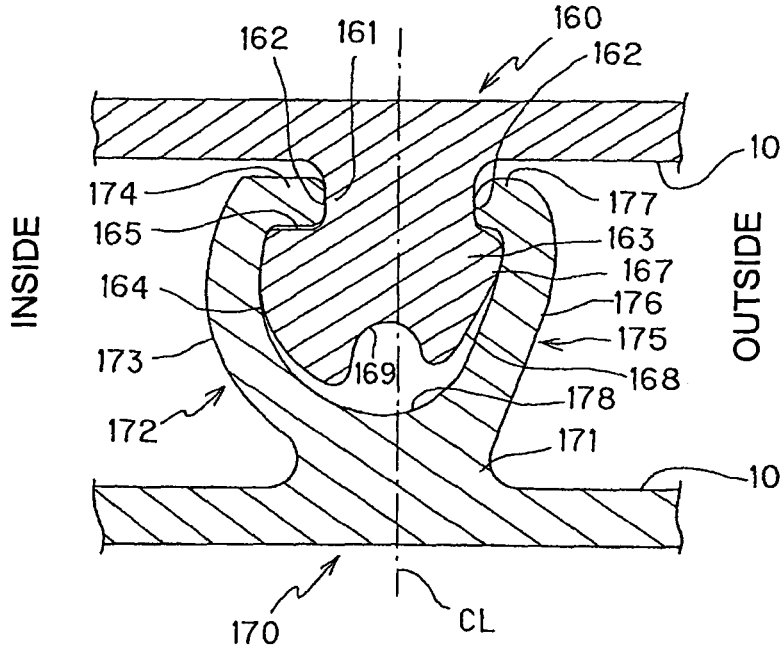
FIG. 28 is a cross-sectional view of the fastener having the male fastener element and the female fastener element engaged together.

FIGS. 26 to 28 illustrated one example of such structure. This fastener may be applied as the fastener 100 formed integrally with the spout unit 3, 3A and the pick-up tab 124, 134, and in the following, an example of the fastener which is applicable to the spout unit 3 will be explained.

FIG. 26 illustrates a cross section of a male fastener element 160. The engaging projection of the male fastener element 160 is composed of a base root portion 161 projecting from the wall surface portion 10 of the spout unit and an engaging portion 163 formed to a front end of this base root portion 161.

The base root portion 161 has a constant thickness and height. In the meantime, the engaging portion 163 is formed such that the side portions of the engaging portion 163 protrude from both side surfaces of the base root portion 161 in its thickness direction. As is apparent from FIG. 26, the contour of the engaging portion 163 in its cross section is formed asymmetrically in lateral direction such that one side, i.e., the right half side, with respect to a boundary center line CL, is largely protruded outward and the other one side, i.e., left half side, is also protruded outward relatively to be small.

In FIG. 26, the one side (right half side) with respect to the center line CL has a contour provided with a circular-arc portion 164 protruded outward. This circular-arc portion 164 is formed from the boundary portion between the engaging portion 163 and the base root portion 161 toward the front end portion of the engaging portion 163. Further, this one side forming the right half side is provided with a portion to be engaged 165 formed so as to protrude outward at the boundary portion between the circular-arc portion 164 and the base root portion 161. This engagement portion to be engaged 165 is a portion protruded outward to be substantially perpendicular to the side surface 162 of the base root portion 161.

On the contrary, the other side forming the left half side with respect to the center line CL is provided with a mount-shaped portion 167 so as to protrude outward from the side surface 162 of the base root portion 161, and provided with an oblique portion 168 linearly obliquely extending from the mount portion 167 toward the center side front end portion of the engaging portion 163.

To the front end of the engaging portion 163, is formed a groove portion 169 along the axial direction of the male fastener element 160. This groove portion 169 is formed by caving the front end portion of the engaging portion 163 in a circular-arc shape.

FIG. 27 illustrates a cross sectional view of the female fastener element 170. The female fastener element 170 is composed of a seat portion 171 projecting from the wall surface portion 10 of the spout unit 3, and a pair of groove walls 172, 175 extending from the front end of the seat portion 171. The seat portion 171 has a constant thickness. On the other hand, the groove walls 172 and 175 are formed with engaging grooves 179 in their inside surface portions, and a wall portion having a constant thickness is formed so as to extend from the front end portion of the seat portion 171 further frontward. Furthermore, the groove walls 172 and 175 extend in a manner inclined obliquely outward so that a distance between these groove walls 172 and 175 is widened toward the front end portions thereof.

Moreover, with the groove walls 172 and 175 of the female fastener element 170, they are laterally asymmetrically formed with respect to the center in the thickness direction. In FIG. 27, one side groove wall 172, i.e., left side, with respect to the center line CL, is largely protruded outward, and the other one side groove wall 175, i.e., right side, is also protruded outward relatively to be small.

First, hereunder, the one side groove wall 172 forming the left side on the center line CL will be explained. This groove wall 172 has substantially the constant thickness, and is composed of a circular-arc portion 173 formed in a circular-arc shape from the seat portion 171 toward the front end side of the groove wall 172 and a first engaging pawl 174 formed so as to be folded from the front end portion of the circular-arc portion 173 toward the center thereof.

The circular-arc portion 173 is formed so that the inner surface thereof is recessed outward in a circular-arc shape, and in relation to the constant thickness of the groove wall 172, the outer surface thereof is protruded outward in a circular-arc shape as like as the inner surface thereof. On the other hand, the first engaging pawl 174 has a thickness substantially the same as that of the circular-arc portion 173 so as to protrude largely from the front end portion of the circular-arc portion toward the central portion thereof. The first engaging pawl 174 of this embodiment is approximately normal to the centerline CL.

On the other hand, the other side groove wall 175 forming the tight side with respect to the center line CL has substantially the constant thickness, and the inner surface thereof is composed of an oblique portion 176 having an inner surface extending linearly from the seat portion 171 toward the front end portion thereof and a second engaging pawl 177 projecting from the front end portion of the oblique portion 176 toward the central portion thereof.

The oblique portion 176 has an inner surface formed as an oblique surface so as to extend from the front end portion of the seat portion 171 upwardly outward. This oblique portion 176 has an outer surface extends upwardly outward from the front end portion of the seat portion 171 as like as the inner surface thereof in relation to the constant thickness of the oblique portion 176 so that it inclines entirely. On the other hand, the second engaging pawl 177 projects from the front end portion of the oblique portion 176 toward the central portion relatively to be small in comparison with the first engaging pawl 174 which is largely projects from the circular-arc portion 173. This second engaging pawl 177 projects in a direction approximately normal to the center line CL.

The inner surfaces of these paired groove walls 172 and 175 are smoothly connected through the upper surface 178 of the seat portion 171 having a root portion recessed in a circular-arc shape.

The entire width H1 of the engaging portion 163 constituting the male fastener element 160 is formed to be slightly larger than the entire width H2 of a portion near the front end portions of the circular-arc portion 173 and the oblique portion 176 in the interval between the inner surfaces of the groove walls 172 and 175 forming the female fastener element 170. Furthermore, radius of curvature of the inner surface of the circular-arc portion forming the groove wall 172 is formed to be larger than radius of curvature of the circular-arc portion 164 forming the engaging portion 163, and the inclination of the inner surface of the oblique portion 176 forming the groove wall 175 is formed to be gentler than the inclination of the oblique surface portion 168 forming the engaging portion 163.

FIG. 28 illustrates a state in which the thus formed male fastener element 160 and the female fastener element 170 are engaged with each other.

The male fastener element 160 and the female fastener element 170 are engaged by inserting the engaging portion 163 of the male fastener element 160 into an engagement groove 179 formed between the groove walls 172 and 175 of the female fastener element 170. In this time, as illustrated in FIG. 28, the groove wall 172 positioned on the left side of the center line CL is engaged with the engaging portion 163 in a manner such that the front end portion of the first engaging pawl 174 abuts against the side surface 162 of the base root portion 161 of the male fastener element 160, and the inner surface of the first engaging pawl 174 is closely contacted to the engagement portion 165 to be engaged of the engaging portion 163. However, in the engaged state, a slight gap may be formed between the inner surface of the first engaging pawl 174 and the engagement portion to be engaged 165. On the other hand, the groove wall 175 positioned on the right side of the center line CL is engaged with the engaging portion 163 in a manner such that the front end portion of the second engaging pawl 177 abuts against the side surface 162 of the base root portion 161 and a small gap is formed between the inner surface of the second engaging portion 163 and the oblique surface on the root side forming the mount-shaped portion 167.

Furthermore, in one side of the engaging portion 163 positioned on the left side of the center line CL, a certain constant area of the root portion of the circular-arc portion 164 is tightly contacted to the inner surface of the groove wall 172, and the certain constant area on the front end side is gradually separated from the inner surface of the groove wall 172 so as to form a gap. On the other hand, in the other one side of the engaging portion positioned on the right side of the center line CL, the top portion of the mount-shaped portion 167 is tightly contacted to a portion just near the second engaging pawl 177 at the inner surface of the groove wall 175 so as to form a gap between the front end side beyond the top portion of the mount-shaped portion 167 and the inner surface of the groove wall 175.

In the fastener of this embodiment, only one portion of the engaging portion 163 is engaged with the inner surface of each of the groove walls 172 and 175, so that a force transferred from the engaging portion to the groove walls 172 and 175 is not dispersed and concentrically transferred, thus engaging them with strong force.

Further, a gap formed by a groove 169 formed to the front end portion of the engaging portion 163 is provided between the front end portion of the engaging portion 163 of the male fastener element 160 and the groove bottom of the engagement groove 179 of the female fastener element 170. This gap has a function of storing material or like adhering on the surface of the engaging portion 163 and material or like remaining inside the engagement groove 179. That is, when powder like material accommodated in a packaging bag with a fastener is poured out, in a certain case, an inner content may adhere on the surface of the engaging portion 163 or may remain in the engagement groove 179. In such state, if the fastener is closed, the inner content may clog a portion between the engaging portion 163 and the engagement groove 179 in a conventional fastener, and both may be engaged in an incomplete manner. However, according to the fastener of the present invention, the inner content is accommodated inside the gap, mentioned above, and the blocking of the engagement of both the engaging portion 163 and engagement groove 179 by the inner content can be surely prevented from occurring.

In the fastener of the structure mentioned above, as illustrated in FIG. 28, the one side positioned on the left side of this figure is directed inward of the packaging bag, and on the other hand, the other side positioned on the right side is directed outward of the packaging bag.

Each of the spout units 3 and 3A is formed to provide a pyramid shape so as to be finely tapered outward after opening the seal. Therefore, when it is intended to separate both the wall surfaces 10 from each other for disengaging the fastener, moment is caused at a position of the fastener with the outside thereof being fulcrum. Then, in a case where the fastener is disengaged, in FIG. 28, in a portion on the right side from the center line CL, the engaging portion 163 is separated from the engagement groove 179 with a force smaller than that required in a portion on the left side from the center line CL. By effectively utilizing such function, in the fastener of this embodiment, in spite of the fact that the male fastener element 160 and the female fastener element 170 are strongly engaged, both the fastener elements are disengaged from each other with a smaller force in comparison with a fastener which is formed laterally symmetrically.

Figure 29:
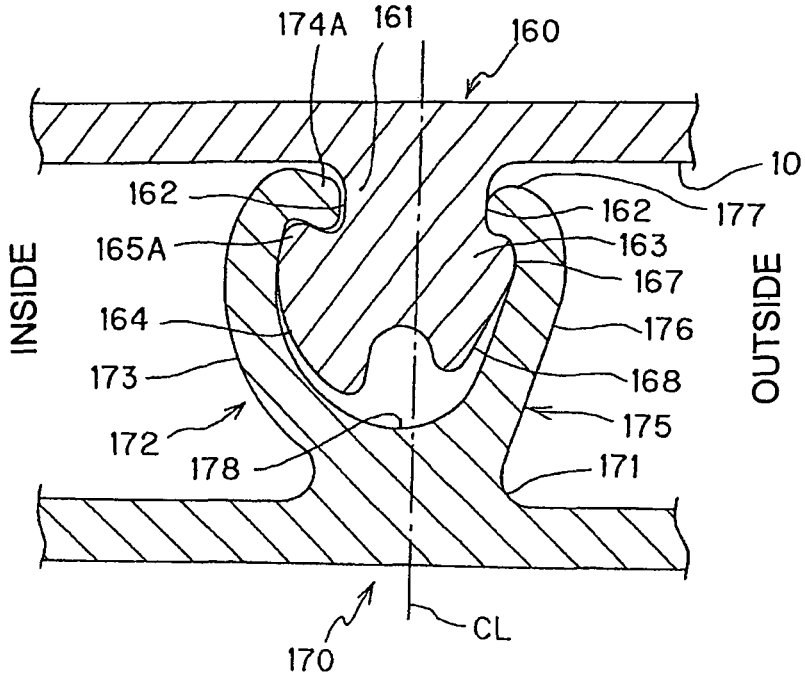
FIG. 29 is a cross-sectional view of the fastener having the male fastener element and the female fastener element engaged each other, according to another embodiment.

Further, the engaging portion 163 constituting the male fastener element 160 and the groove walls 172 and 175 constituting the female fastener element 170 may be formed in shapes illustrated in FIG. 29. Since basic structures of the fastener illustrated in FIG. 29 is substantially identical to those of the fasteners illustrated in FIGS. 26 to 28, the same reference numerals are added to corresponding portions, and detailed description thereof is omitted herein.

In the fastener illustrated in FIG. 29, the portion 165A to be engaged of the engaging portion 163 constituting the male fastener element 160 is protruded outward from the side surface of the base root portion 161 and then returned toward the wall surface side constituting the spout unit. However, the male fastener element 160 has substantially the same structure as that illustrated in FIG. 26 except for this portion 165A to be engaged.

On the other hand, as to the female fastener element 170, the first engaging pawl 174A is directed toward the center of the circular-arc portion 173 from the front end thereof and then is projected so as to be returned to the groove bottom side. With this female fastener element 170, it has substantially the same structure as that illustrated in FIG. 27 except for the first engaging pawl 174A.

As mentioned above, according to the thus formed fastener, the engaging portion 163 of the male fastener element 160 is engaged with the groove walls 172 and 175 of the female fastener element 170 in a manner such that the inner surfaces of the first engaging pawl 174A clamp the portion 165A to be engaged and a portion of the circular-arc portion 164. Thus, both the fastener elements are more firmly engaged with each other.

The invention claimed is:

1. A packaging bag, the packaging bag comprising:

a bag body comprising opposing flat surface portions and a corner portion including insertion through-holes for insertion respectively formed in the flat surface portions;

a spout unit fused to the bag body and being configured to remove inner content out from the bag body through the spout unit, the spout unit including a pair of wall surface portions opposing each other, the wall surface portions having central foldable lines at portions forming center lines of the respective wall surface portions, the central foldable lines being configured to fold the wall surface portions;

a fastener comprising a male fastener element and a female fastener element provided on inner surfaces of the paired wall surface portions and opposed to each other, the male fastener element and the female fastener element being configured to engage with or disengage from each other to thereby open or close an opening of the packaging bag when the packaging bag is seal-opened, the fastener being bent to be convex toward an inside of the bag body; and pick-up tabs provided on outer surfaces of the wall surface portions at areas corresponding to or near a mounting portion of the male fastener element and a mounting portion of the female fastener element, respectively, so as to project outward of the flat surface portions of the bag body, the pick-up tabs corresponding to portions of the wall surface portions where the fastener is bent and are formed parallel with the central foldable lines, the pick-up tabs being configured to be inserted into the insertion through-holes from the inside of the bag body and project outward of the flat surface portions of the bag body.

2. The packaging bag according to claim 1, wherein a peripheral edge of the spout unit accords with a peripheral edge of the bag body, and the peripheral edges of the spout unit and the bag body are overlapped and then sealed integrally.

3. The packaging bag according to claim 1, wherein the fastener is bent to be convex toward an inside of the bag body at least when the male fastener element and the female fastener element are engaged with each other.

4. The packaging bag according to claim 1, wherein the spout unit is mounted to the bag body by being positioned between the flat surface portions of the bag body.

5. The packaging bag according to claim 1, wherein each of the pick-up tabs projects from the outer surface of the wall surface portion at a side of the center foldable line of the wall surface portion.

6. The packaging bag according to claim 1, wherein each of the pick-up tabs projects from the outer surface of the wall surface portion at a position corresponding to an intermediate portion in an extending direction of the center foldable line of the wall surface portion.

* * * * *

UNITED STATES PATENT AND TRADEMARK OFFICE

CERTIFICATE OF CORRECTION

PATENT NO. : 8,641,279 B2
APPLICATION NO. : 12/293563
DATED : February 4, 2014
INVENTOR(S) : Ichikawa et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1416 days.

Signed and Sealed this
Twenty-second Day of September, 2015

Michelle K. Lee

Michelle K. Lee
*Director of the United States Patent and Trademark Office*